United States Patent [19]

Van Doren

[11] 4,254,886

[45] Mar. 10, 1981

[54] CAN BODY HAVING A LATERALLY PROJECTING FLANGE

[75] Inventor: Hendrik D. Van Doren, Colmschate, Netherlands

[73] Assignee: Thomassen en Drijver-Verblifa N.V., Deventer, Netherlands

[21] Appl. No.: 31,223

[22] Filed: Apr. 18, 1979

Related U.S. Application Data

[63] Continuation of Ser. No. 934,312, Aug. 17, 1978, abandoned, and Ser. No. 674,057, Apr. 5, 1976, abandoned.

[30] Foreign Application Priority Data

Apr. 2, 1975 [NL] Netherlands ..... 7503926

[51] Int. Cl.[3] ..... B65D 8/08

[52] U.S. Cl. ..... 220/74; 220/67

[58] Field of Search ..... 220/67, 74, 66; 113/120 H, 120 V, 120 Y, 120 AA

[56] References Cited

U.S. PATENT DOCUMENTS

| | | | |
|---|---|---|---|
| 167,172 | 8/1875 | Herset | 220/67 |
| 1,607,923 | 11/1926 | Sebell | 220/67 |
| 2,251,987 | 8/1941 | Conway, Jr. | 220/67 |
| 2,327,731 | 8/1943 | McClary | 113/120 Y |
| 2,335,647 | 11/1943 | Chamberlain | 220/74 X |
| 2,384,042 | 9/1945 | O'Brien | 113/120 Y X |
| 2,971,671 | 2/1961 | Shakman | 220/66 |
| 3,698,596 | 10/1972 | potts | 220/67 |
| 3,709,398 | 1/1973 | Fuhrmann | 220/67 |
| 3,952,677 | 4/1976 | Hartman et al. | 220/66 X |
| 4,037,550 | 7/1977 | Zofko | 113/120 Y |

FOREIGN PATENT DOCUMENTS

| | | | |
|---|---|---|---|
| 2257210 | 5/1974 | Fed. Rep. of Germany | 113/120 AA |
| 45327 | 2/1939 | Netherlands | 220/67 |
| 54962 | 6/1943 | Netherlands | 113/120 Y |
| 6406281 | 12/1964 | Netherlands | 220/66 |
| 154127 | 7/1932 | Switzerland | 220/74 |
| 1043649 | 9/1966 | United Kingdom | 220/68 |

*Primary Examiner*—Allan N. Shoap

*Attorney, Agent, or Firm*—John P. Snyder

[57] ABSTRACT

Can body, particularly made of thin drawn metal sheet, having a laterally projecting flange intended for sealingly securing the end wall to the can body, said flange being doubled. Preferably the flange is folded towards the side remote from the body, while the diameter of the free end of the doubled flange does not exceed the diameter of the main part of the can body. The invention additionally relates to such can body having an end wall sealingly secured thereto.

7 Claims, 4 Drawing Figures

CAN BODY HAVING A LATERALLY PROJECTING FLANGE

This is a continuation of application Ser. No. 934,312, filed Aug. 17, 1978 and Ser. No. 674,057, filed Apr. 5, 1976, both abandoned.

The invention relates to a can body having a laterally projecting flange.

Such can bodies, particularly those made of thin, drawn metal sheet, are found in practice to provide an undesirably high percentage of insufficiently sealed cans after they have been provided with a lid by means of a double seamed joint so that the contents tend to deteriorate. This inadequate seal can be avoided largely or even completely by using can bodies having a doubled flange. In order to restrict the stress in the material of the flange to a minimum, the flange is preferably folded towards the side remote from the body.

Satisfactory results are obtained particularly when the body has a necked-in portion. It is furthermore preferred for the diameter of the free end i.e. the cut-off end of the doubled flange not to exceed the diameter of the main portion of the body.

The invention furthermore relates to a can having a can body in any of the preceding embodiments with a lid secured thereto by means of a double seamed joint comprising the doubled flange.

The invention will be described more fully with reference to the accompanying drawings.

Figure 1:
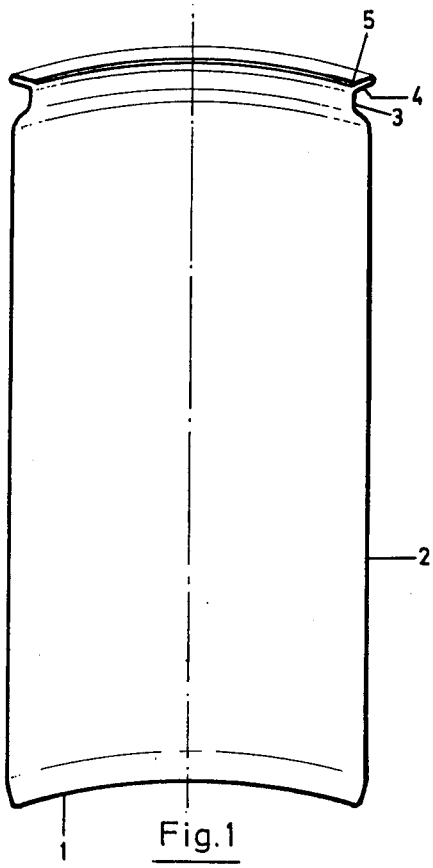
FIG. 1 is an axial sectional view of a can body in accordance with the invention.

FIG. 1 shows a preferred embodiment of a can body in accordance with the invention in an axial sectional view. This can body comprises a bottom 1, a cylindrical wall 2, a necked-in portion 3 and a laterally projecting flange 4, which is folded towards the side remote from the body. Such a body may very satisfactorily consist of thin, drawn steel sheet having a thickness of 0.15 mm.

The diameter of the free end 5 of the folded flange 4 is smaller than the diameter of the cylindrical part 2 of the body.

Figure 3:
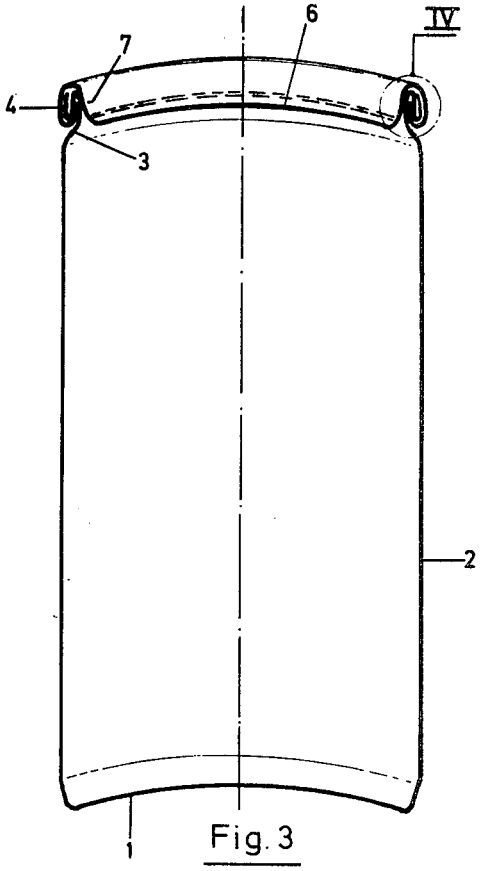
FIG. 3 is an axial sectional view of the can body of FIG. 1, to which a lid is secured by means of a double seamed joint.
Figure 2:
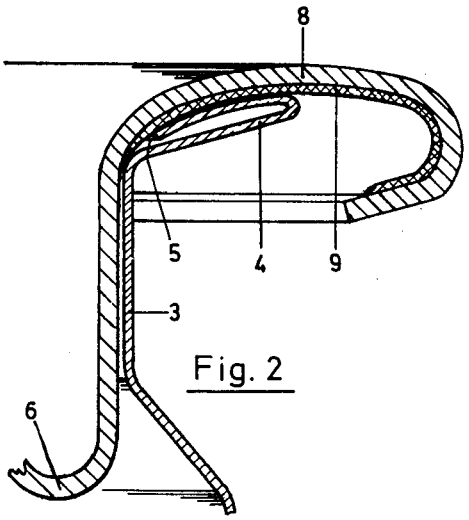
FIG. 2 is an enlarged sectional view of a flange of the can body of FIG. 1, on which a lid is deposited but not yet fastened.
Figure 4:
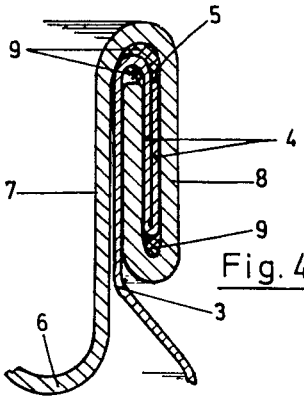
FIG. 4 is an enlarged sectional view of detail IV in FIG. 3.

Such a can body may be closed in a conventional manner by means of a lid 6, for example, of 0.35 mm aluminium sheet, having a cylindrical chuck wall 7 and a projecting flanged edge 8, in which sealing material 9 is arranged. This lid 6 is deposited on the can body as is shown in the enlarged detail in FIG. 2, the flanged edge 8 being subsequently bent around the flange 4 so that the flange 4 is bent over downwardly and the can shown in the sectional view of FIG. 3 is obtained. The seamed joint thus obtained is shown on an enlarged scale in FIG. 4.

Since the problem of inadequately sealed cans is practically only involved in the use of can bodies of steel sheet of a thickness gauge not over 0.20 mm or of aluminium sheet of a thickness gauge not over 0.25 mm, the double folded flange is particularly used with lighter gauge sheet.

As a matter of course, the invention is not at all restricted to the embodiment shown and described; it may also be effectively employed with conventional cylindrical can bodies. Also with these can bodies it is advisable for the diameter of the free end of the doubled flange not to exceed the diameter of the main part of the body.

What we claim is:

1. An unseamed can body comprising, in combination:

a main wall portion of cylindrical form and of thin, drawn sheet metal;

flange means at one end of said main wall portion for providing a radially outwardly double seamed joint with a lid while restricting the stress of the material of the flange means to a minimum during deformation thereof upon seaming the lid thereto, said flange means comprising a radially outwardly projecting first annular portion, a radially inwardly projecting second annular portion overlying said first annular portion, and an integral fold portion joining the peripheries of said first and second annular portions;

said second annular portion presenting a radially inwardly facing circular inner free edge spaced above said first annular portion;

said radially inwardly facing circular inner free edge presenting a diameter which does not exceed the diameter of said main wall portion, a necked-in portion including a wall portion of cylindrical form positioned between said main wall portion and said first annular portion;

said necked-in cylindrical wall portion being joined by deformable radius means to said first annular portion for bending said flange means downwardly exteriorly of said necked-in portion for forming said lateral double seamed joint with a lid; and said radially inwardly facing circular inner free edge being disposed adjacent said radius means.

2. The unseamed can body as defined in claim 1 including a generally frusto-conical wall portion joining said cylindrical form wall portion to said cylindrical main wall portion.

3. The unseamed can body as defined in claim 1 wherein said circular inner free edge is of a diameter greater than the diameter of said cylindrical form wall portion and less than the diameter of said cylindrical main wall portion.

4. The unseamed can body as defined in claim 3 wherein said integral fold portion is of a diameter substantially the same as the diameter of said cylindrical main wall portion.

5. The unseamed can body as defined in claim 1 wherein said circular inner free edge is of a diameter which does not exceed the diameter of said cylindrical main wall portion.

6. The unseamed can body as defined in claim 5 wherein said integral fold portion is of a diameter substantially the same as the diameter of said cylindrical main wall portion.

7. The unseamed can body as defined in claim 1 wherein said integral fold portion is of a diameter substantially the same as the diameter of said cylindrical main wall portion.

* * * * *